US009972461B2

(12) United States Patent
Chen et al.

(10) Patent No.: US 9,972,461 B2
(45) Date of Patent: May 15, 2018

(54) KEY STRUCTURE WITH MECHANICAL SWITCH AND MECHANICAL SWITCH THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventors: Chun-Lin Chen, Taipei (TW); Ko-Hsiang Lin, Taipei (TW); Chih-Wen Su, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days. days.

(21) Appl. No.: 15/656,254

(22) Filed: Jul. 21, 2017

(65) Prior Publication Data

US 2018/0090286 A1 Mar. 29, 2018

(30) Foreign Application Priority Data

Sep. 29, 2016 (CN) ..... 2016 1 0866848

(51) Int. Cl.
*H01H 13/14* (2006.01)
*H01H 13/10* (2006.01)
*H01H 13/04* (2006.01)

(52) U.S. Cl.
CPC ..... *H01H 13/14* (2013.01); *H01H 13/04* (2013.01); *H01H 13/10* (2013.01); *H01H 2235/01* (2013.01)

(58) Field of Classification Search
CPC ..... H01H 13/52; H01H 13/04; H01H 13/14; H01H 13/70; H01H 2233/07; H01H 2235/01; H01H 13/10; H01H 13/83; H01H 2219/044; H01H 2219/062; H01H 2219/064; H01H 2229/02; H01H 2219/066
USPC ..... 200/344, 5 A, 314, 517
See application file for complete search history.

(56) References Cited

U.S. PATENT DOCUMENTS 6,242,705 B1 * 6/2001 Huang ..... H01H 13/705 200/341
8,937,520 B2 * 1/2015 Kan ..... H01H 36/00 335/205
2010/0108481 A1 * 5/2010 Chiang ..... H01H 13/83 200/310

* cited by examiner

*Primary Examiner* — Edwin A. Leon
(74) *Attorney, Agent, or Firm* — Li & Cai Intellectual Property (USA) Office

(57) ABSTRACT

A key structure with mechanical switch includes a keycap, a support plate board disposed under the keycap, a scissor unit, a receiving housing, a guiding outer cylinder, a rotating inner cylinder and an elastic element. The scissor unit guides the keycap up or down along a pressing direction. The receiving housing has a plurality of sectional boards and a plurality of sectional cutouts. The guiding outer cylinder is movably received in the receiving housing along the pressing direction, and abuts against a bottom surface of the keycap. The guiding outer cylinder has a plurality of positioning bumps and a plurality of lodging recesses. The rotating inner cylinder is received in the guiding outer cylinder and has a plurality of sliding bumps. The elastic element is located in the rotating inner cylinder to provide elasticity toward the keycap. The present disclosure also provides a mechanical switch.

22 Claims, 9 Drawing Sheets

KEY STRUCTURE WITH MECHANICAL SWITCH AND MECHANICAL SWITCH THEREOF

BACKGROUND OF THE INVENTION

1. Field of the Invention

The present disclosure is related to a key structure with a mechanical switch and a mechanical switch thereof. In particular, the present disclosure relates to a key having a mechanical switch to output a signal or a command in a mechanical manner, which can be applied to, for example, a computer.

2. Description of Related Art

Keyboards have become a very popular computer periphery equipment, and there are two general types of keyboards: mechanical type keyboards and membrane type keyboards. The membrane type keyboard has a keycap, a scissor frame under the keycap, an elastic element, and a circuit membrane on a bottom of the keyboard. When the keycap is pressed, the elastic element is pressed by the keycap downward to contact the circuit membrane, so as to produce and output a signal. A drawback of the membrane type keyboard is that, if a single circuit belonging to a single key is damaged, the entire circuit membrane needs to be replaced or even cannot be fixed, with no option of replacing a single key available. In addition, the operating tactility is decided by the elastic element, and since a distance of the pressing stroke is short with an unapparent tactile feedback, the tactility of the membrane type keyboard is relatively poor when compared with the mechanical type keyboard.

The mechanical type keyboard has a mechanical switch to produce a signal. It has the advantages of providing a specific tactile feedback when a key is pressed, and a long lifespan.

The current mechanical type keyboard usually has a spring structure disposed on a central axle. The height of the spring structure is generally higher than that of membrane type keyboard. In addition, its elasticity graph during a pressing stroke has a curve line curved downward after passing a "peak point" until reaching a valley where lies an "operating point", and a diagonal line extending gradually upward. No apparent tactile sensation of bump feedback is present in the current mechanical type keyboard.

SUMMARY OF THE INVENTION

One of the objectives of the present disclosure is to provide a mechanical switch structure, which can lower a total height of a mechanical switch structure, and increase the stability of operation.

Another of the objectives of the present disclosure is to provide a mechanical switch structure, which can provide a more apparent tactile sensation of bump feedback.

In order to achieve the above objectives, according to one exemplary embodiment of the present disclosure, a key structure with a mechanical switch includes a keycap, a support plate, a scissor unit, a receiving housing, a guiding outer cylinder, a rotating inner cylinder and an elastic element. The support plate is disposed under the keycap, and has an opening. The scissor unit is disposed between the keycap and the support plate, so as to guide the keycap to move up or down along a pressing direction. The receiving housing is disposed under the support plate. The receiving housing has a plurality of sectional boards arranged in an annular manner and a plurality of sectional cutouts formed among the sectional boards at intervals. The guiding outer cylinder is received in the receiving housing and movably arranged in the pressing direction. The guiding outer cylinder protrudes beyond the opening and abuts against a bottom surface of the keycap. The guiding outer cylinder has a main cylinder part, a plurality of positioning bumps protruding outward from a bottom of the main cylinder part, and a plurality of lodging recess arranged among the positioning bumps at intervals. The guiding outer cylinder has a downward-facing hollow receiving space. The rotating inner cylinder is received in the hollow receiving space of the guiding outer cylinder. The rotating inner cylinder has an inner cylinder part, and a plurality of sliding bumps protruding outward from a bottom of the inner cylinder part. The elastic element is disposed underneath the rotating inner cylinder, so as to provide the rotating inner cylinder with an elastic force toward the keycap. When the keycap is not pressed, the sliding bumps are respectively arranged on the bottom ends of the positioning bumps, and in the sectional cutouts. When the keycap is pressed, the positioning bumps move away from the sectional cutouts in the pressing direction, and the sliding bumps are respectively slid on bottom ends of the positioning bumps into the lodging recesses. When the keycap is released, the sliding bumps are slid on bottom surfaces of the sectional boards to bottom ends of the positioning bumps.

In order to achieve the above objectives, according to one exemplary embodiment of the present disclosure, a mechanical switch includes a receiving housing, a guiding outer cylinder, a rotating inner cylinder and an elastic element. The receiving housing has a plurality of sectional boards arranged in an annular manner and a plurality of sectional cutouts formed among the sectional boards at intervals. The guiding outer cylinder is received in the receiving housing and movably arranged in a pressing direction. The guiding outer cylinder is abutted against a keycap. The guiding outer cylinder has a main cylinder part, a plurality of positioning bumps protruded outward from a bottom of the main cylinder part, and a plurality of lodging recesses arranged among the positioning bumps at intervals. The guiding outer cylinder has a downward-facing hollow receiving space. The rotating inner cylinder is received in the hollow receiving space of the guiding outer cylinder. The rotating inner cylinder has an inner cylinder part and a plurality of sliding bumps protruding outward from a bottom of the inner cylinder part. The elastic element is disposed underneath the rotating inner cylinder, so as to provide the rotating inner cylinder with an elastic force toward the guiding outer cylinder. When the guiding outer cylinder is not pressed, the sliding bumps are respectively arranged on the bottom ends of the positioning bumps, and in the sectional cutouts. When the guiding outer cylinder is pressed, the positioning bumps move away from the sectional cutouts in the pressing direction, the sliding bumps are respectively slid on bottom ends of the positioning bumps into the lodging recesses. When the guiding outer cylinder released, the sliding bumps are slid on bottom surfaces of the sectional boards to bottom ends of the positioning bumps.

Thus, the present disclosure has advantages as follows. During the pressing and releasing processes of the keycap, the rotating inner cylinder is slid along a bottom surface of the guiding outer cylinder and the sectional board. The sliding bump is slidably arranged on the bottom surface of the positioning bump and in the sectional cutouts in turn, so that it can provide a noticeable tactile feedback of a bump. The click ratio CR % of pressure forces in this embodiment is about 50%.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

Figure 1:
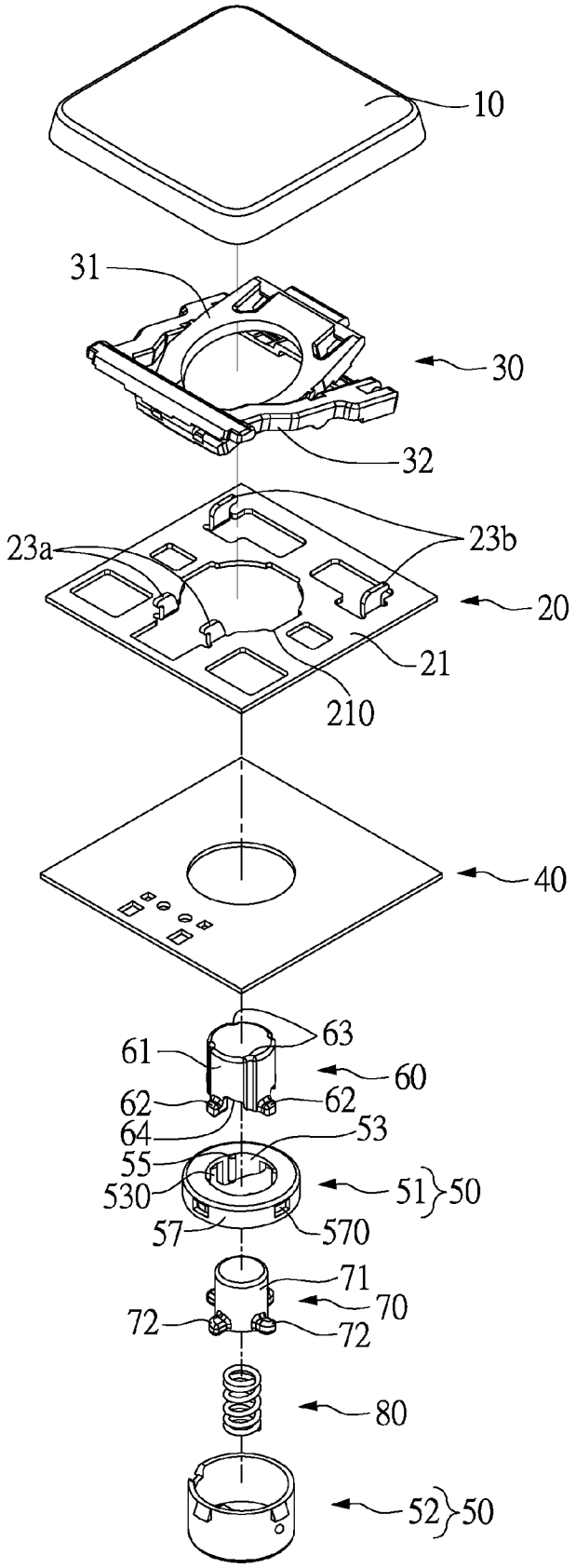
FIG. 1 is an exploded perspective view of a key structure with mechanical switch of the present disclosure.

The aforementioned illustrations and following detailed descriptions are exemplary for the purpose of further explaining the scope of the present disclosure. Other objectives and advantages related to the present disclosure will be illustrated in the subsequent descriptions and appended drawings.

First Embodiment

Referring to FIGS. 1, 1A, 2, and 2A, a key structure with mechanical switch includes a keycap 10, a support plate 20 disposed under the keycap 10, a scissor unit 30, a receiving housing 50, a guiding outer cylinder 60, a rotating inner cylinder 70 and an elastic element 80. The receiving housing 50, the guiding outer cylinder 60, the rotating inner cylinder 70 and the elastic element 80 are configured to a mechanical switch according to the present disclosure.

In this embodiment, the support plate 20 can be formed from a metal plate by punching. The support plate 20 has a main body 21, and a plurality of fixation portions 23*a*, 23*b* extended upward and curvedly from the main body 21 toward the keycap 10. The support plate 20 has an opening 210 formed on the main body 21.

Figure 2:
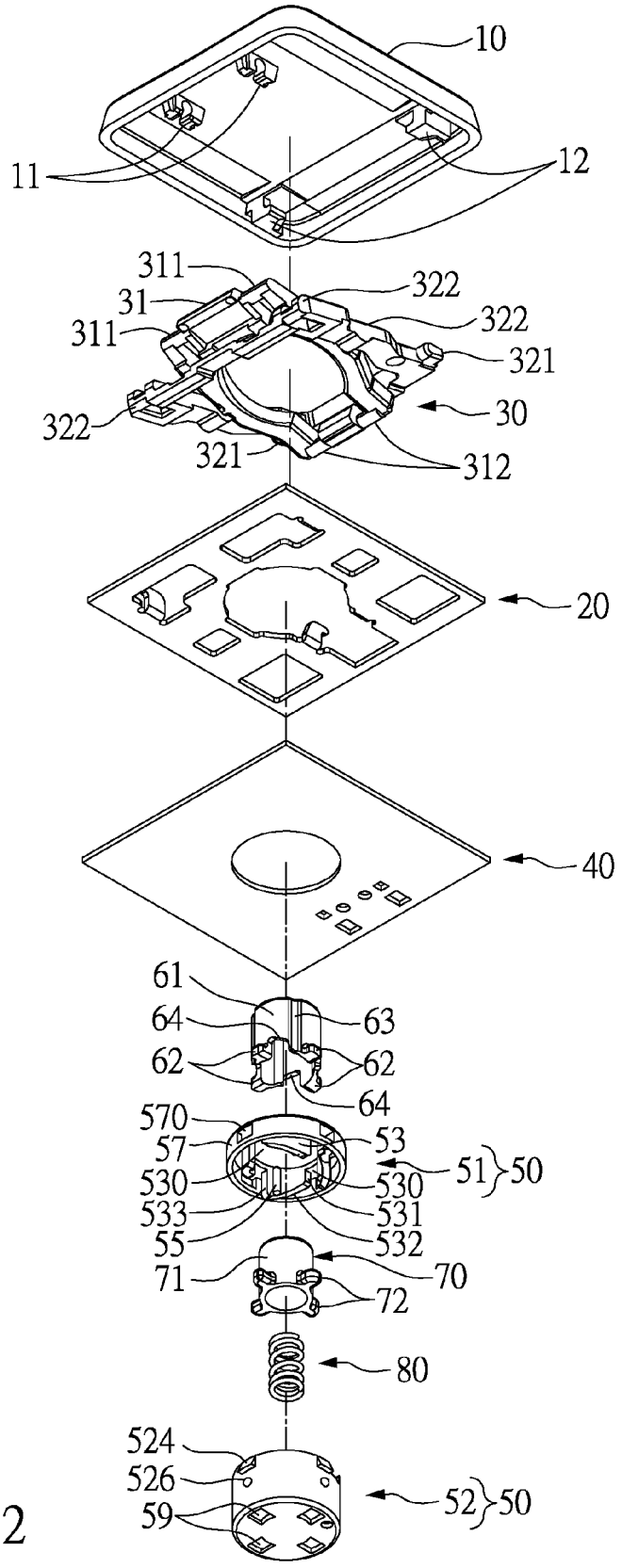
FIG. 2 is another exploded perspective view of a key structure with mechanical switch of the present disclosure.

As shown in FIG. 2 of this embodiment, the scissor unit 30 is a scissor-type structure, which is arranged between the keycap 10 and the support plate 20 to guide the keycap 10 upward or downward along a pressing direction (a vertical direction of FIG. 1). The keycap 10 has a plurality of connecting portions 11, 12 formed on a bottom surface thereof. The scissor unit 30 has a first frame 31 and a second frame 32 rotatably connected to the first frame 31. Two sides of the first frame 31 and two sides of the second frame 32 are connected to the fixation portions 23*a*, 23*b* and the connecting portions 11, 12, respectively. As shown in FIG. 1, the first frame 31 has a plurality of first axles 311, 312, which are respectively formed on an upper side and a lower side thereof, and pivotally connected to the connecting portions 11 of the keycap 10 and the fixation portions 23*b* of the support plate 20. As shown in FIG. 2, the second frame 32 has a plurality of second axles 321, 322, which are respectively formed on an upper side and a lower side thereof, and pivotally connected to the connecting portions 12 of the keycap 10 and the fixation portions 23*a* of support plate 20. Thus, this embodiment can reduce a total height and raise the operational stability of the mechanical switch.

Figure 1A:
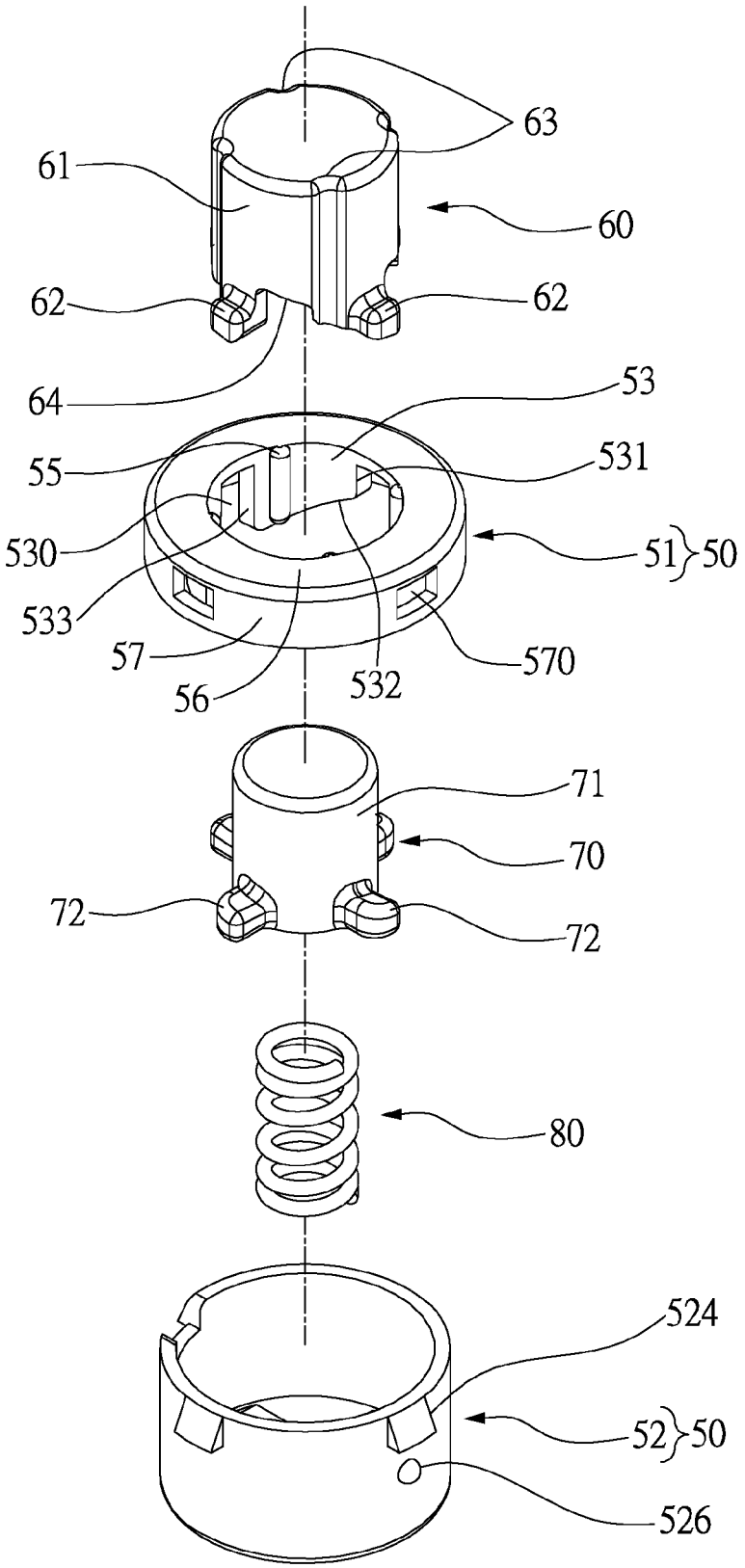
FIG. 1A is an exploded perspective view of a mechanical switch of the present disclosure.

Referring to FIG. 1A, in this embodiment, the receiving housing 50 is disposed under the support plate 20. The receiving housing 50 has a plurality of sectional boards 53 which are arranged in an annular manner, and a plurality of sectional cutouts 530 which are formed among the sectional boards 53 at intervals. While this embodiment has four sectional boards 53, the quantity thereof is not limited to that disclosed herein, and may also be at least two. The receiving housing 50 of this embodiment has an upper housing 51 and a lower housing 52. The upper housing 51 has an outer edge portion 57 which is wedged to the lower housing 52. In this embodiment, the outer edge portion 57 is formed with a plurality of wedding holes 570. The lower housing 52 is formed with a plurality of hooking bumps 524 on an outer surface thereof. The hooking bumps 524 are wedged in the wedding holes 570 correspondingly.

Figure 3:
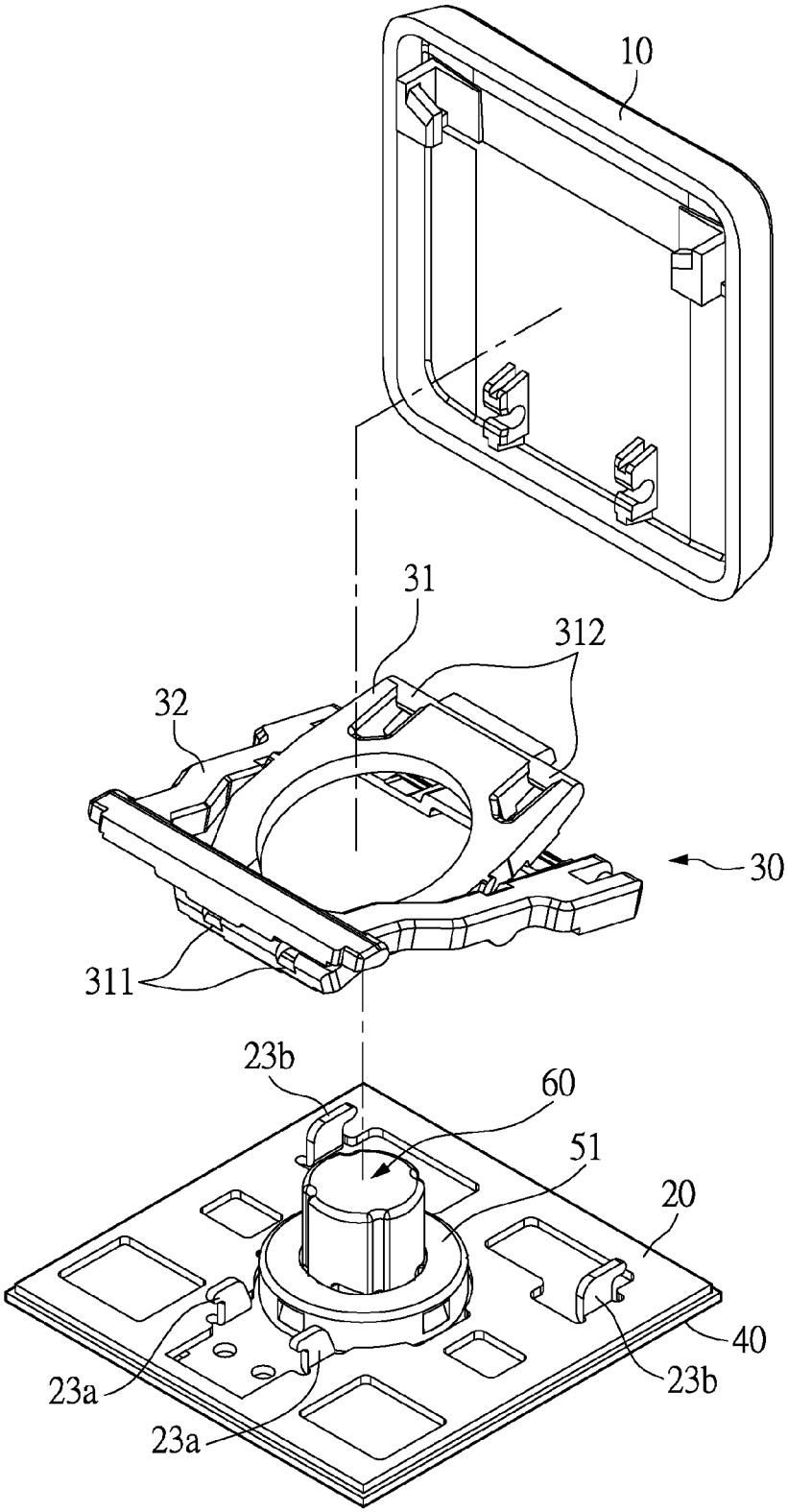
FIG. 3 is an exploded perspective view of a keycap, a scissor unit, and the mechanical switch of the present disclosure.
Figure 4:
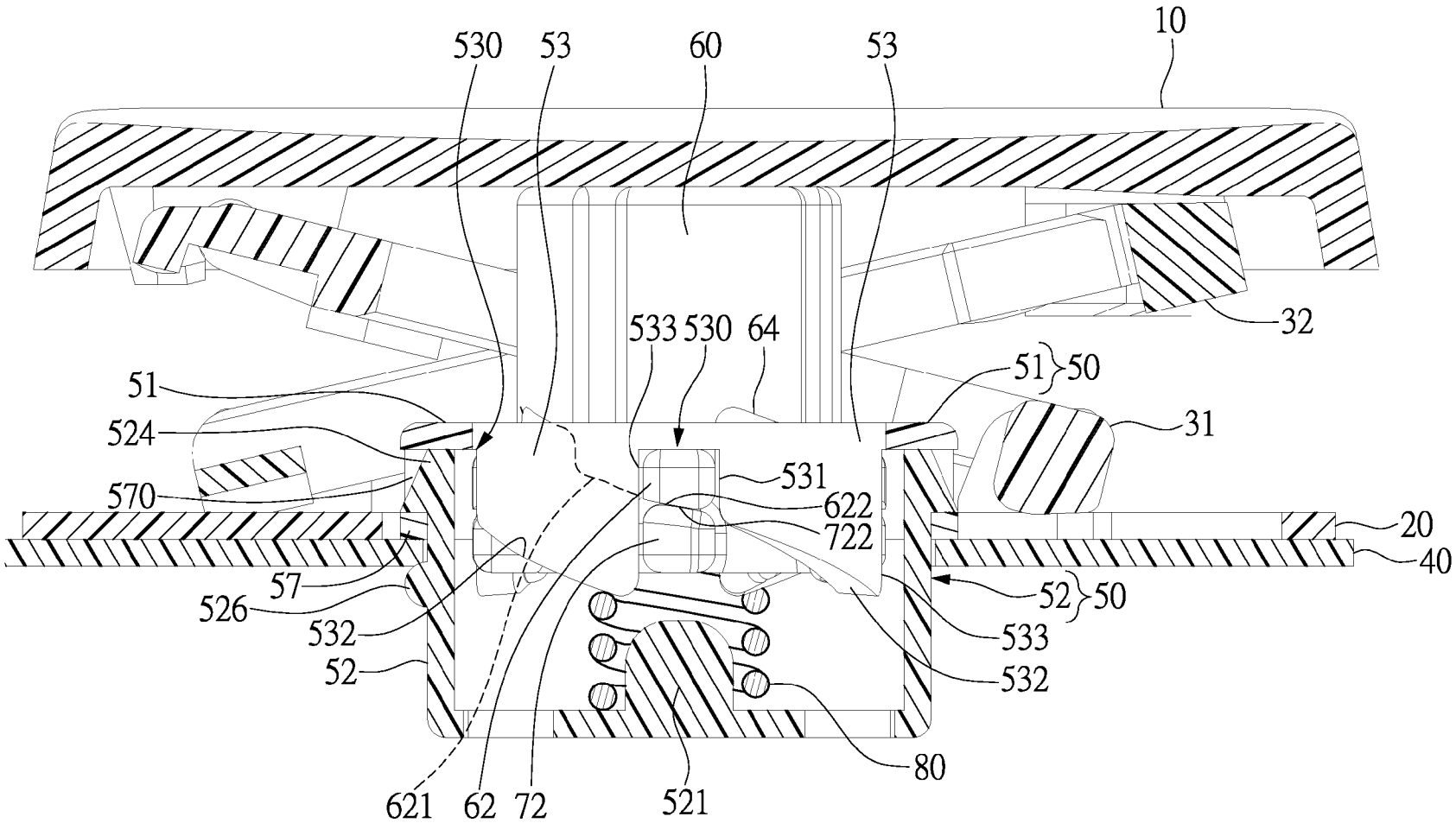
FIG. 4 is a cross-sectional view of the key structure with mechanical switch where a keycap is not pressed.

Referring to FIG. 3, a membrane circuit board 40 is disposed on a bottom surface of the support plate 20. As shown in FIG. 2, the lower housing 52 has a plurality of identification protrusions 526. As shown in FIG. 4, the support plate 20 and the membrane circuit board 40 are cooperatively sandwiched by the hooking bumps 524 and the identification protrusions 526.

Referring to FIG. 1A, in this embodiment, the upper housing 51, in addition to the outer edge portion 57 and the sectional boards 53, further has an annular top part 56 which connects the outer edge portion 57 to the sectional boards 53. The annular top part 56 also covers a top edge of the lower housing 52. The sectional boards 53 are parallel to the outer edge portion 57 and arranged in the outer edge portion 57. The annular top part 56 is substantially perpendicular to the sectional board 53 and the outer edge portion 57.

Figure 2A:
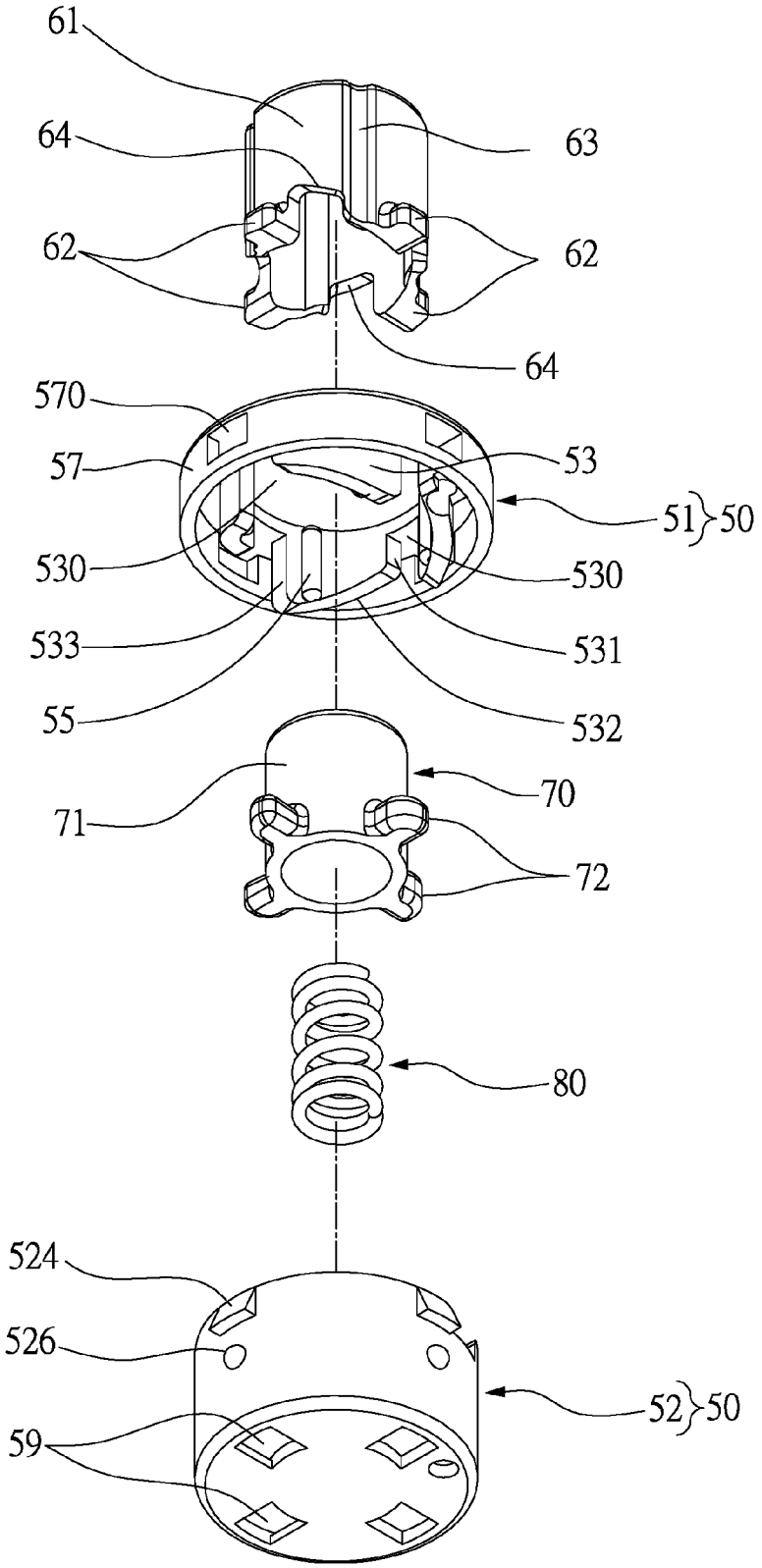
FIG. 2A is another exploded perspective view of the mechanical switch of the present disclosure.

Referring to FIG. 1A and FIG. 2A, each sectional board 53 has a first side 531, a second side 533 and an oblique bottom side 532 which connects the first side 531 to the second side 533. The first side 531 is shorter than the second side 533.

The guiding outer cylinder 60 is received in the receiving housing 50 along a pressing direction of the keycap 10. The guiding outer cylinder 60 is protruded beyond the opening 210 of the support plate 20 and abuts against a bottom surface of the keycap 10. The guiding outer cylinder 60 has a main cylinder part 61, a plurality of positioning bumps 62, and a plurality of lodging recesses 64. The positioning bumps 62 protrude outward from a bottom of the main cylinder part 61. The lodging recesses 64 are alternatingly disposed with the positioning bumps 62. The guiding outer cylinder 60 is substantially shaped in a cylinder and has a hollow receiving space facing downward (as shown FIG. 2A, not labeled). While this embodiment has four positioning bumps 62 and four lodging recesses 64, the quantity thereof is not limited to that disclosed herein, and may also be at least two. The four positioning bumps 62 are coplanar and arranged in an isogonal and equidistant manner.

Referring to FIG. 2 and FIG. 2A, the lower housing 52 is formed with a plurality of yielding holes 59, and positions thereof correspond to that of the positioning bumps 62 of the guiding outer cylinder 60.

Referring to FIG. 1A and FIG. 2A, the guiding outer cylinder 60 of this embodiment is arranged to be unrotatably movable along the pressing direction. Each sectional board 53 has a guiding rib 55 formed on its inner surface along the pressing direction. The guiding outer cylinder 60 is formed with a plurality of guiding slots 63 on its outer surface parallel to the pressing direction so as to correspondingly receive the guiding ribs 55. Preferably, the guiding rib 55 is closer to the second side 533 of the sectional board 53 than the first side 531. In this case, since the second side 533 is longer than the first side 531, the guiding rib 55 can accordingly be longer. In this embodiment, the guiding rib 55 is substantially semi-column shaped.

The rotating inner cylinder 70 is received in the hollow receiving space of the guiding outer cylinder 60 in a movable and rotatable manner along the pressing direction. The rotating inner cylinder 70 has an inner cylinder part 71, and a plurality of sliding bumps 72 which protrude outward from a bottom of the inner cylinder part 71. While this embodiment has four sliding bumps 72, the quantity thereof is not limited to that disclosed herein, and may also be at least two. The four sliding bumps 72 are coplanar and arranged in an isogonal and equidistant manner.

The elastic element 80 is disposed on a bottom of the rotating inner cylinder 70 to provide the rotating inner cylinder 70 with an elastic force toward the keycap 10. In this embodiment, the elastic element 80 is a compressible spring. The lower housing 52 has a protrusive positioning portion 521 on its bottom to position the elastic element 80.

Figure 5:
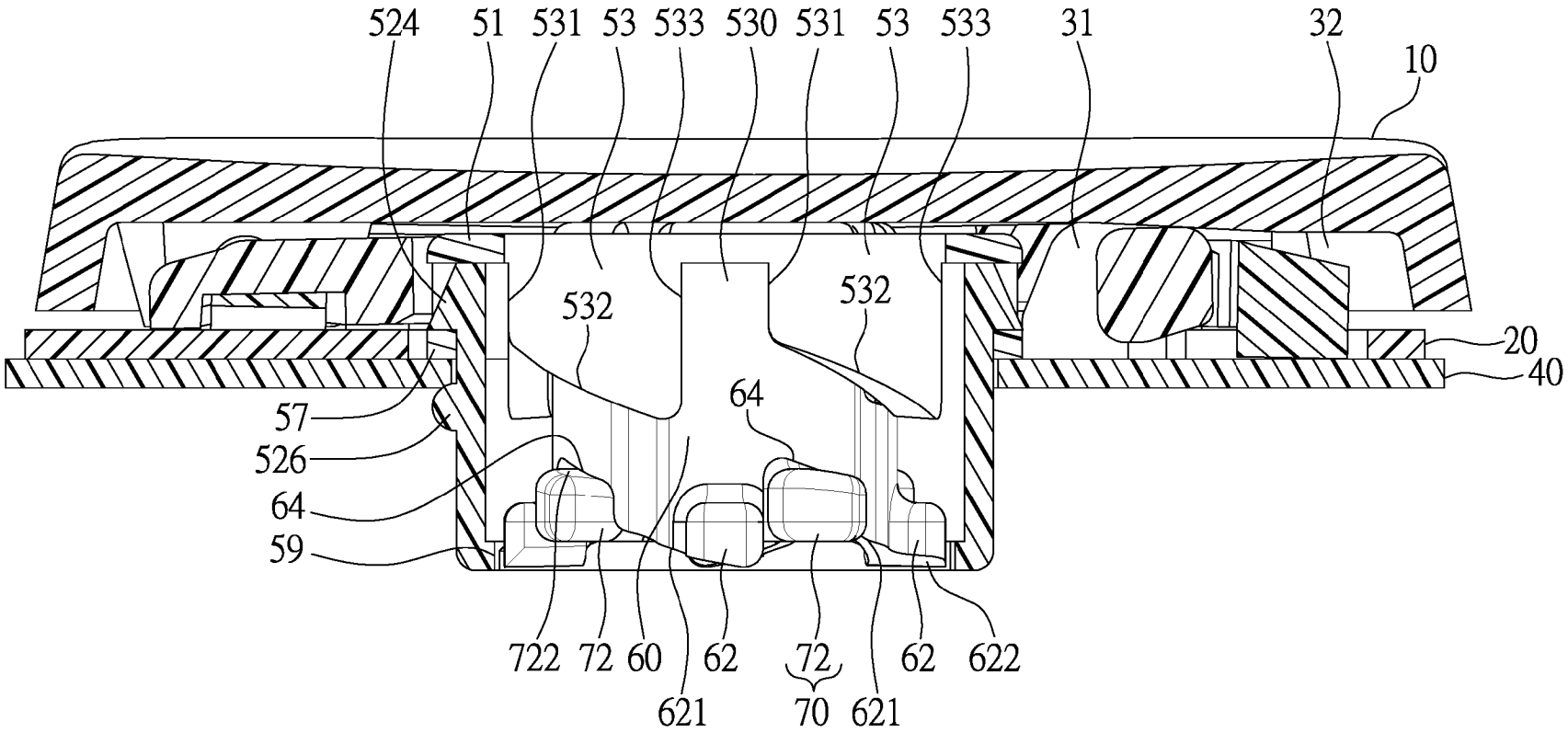
FIG. 5 is a cross-sectional view of the key structure with mechanical switch where a keycap is pressed according to the present disclosure.

Reference is next made to FIG. 4 and FIG. 5. As shown in FIG. 4, when the keycap 10 is not pressed and in a released state, in which the guiding outer cylinder 60 is not pressed down, the sliding bumps 72 are correspondingly located on the bottom ends of the positioning bump 62 in the sectional cutouts 530.

Referring to FIG. 5, each positioning bump 62 of the guiding outer cylinder 60 has a lower slope 622 on its bottom end. The lower slope 622 is oblique relative to the pressing direction. Each of the sliding bumps 72 of the rotating inner cylinder 70 has an upper slope 722 on its top end. The upper slope 722 is oblique relative to the pressing direction. The upper slope 722 is abutted against the lower slope 622.

When the keycap 10 is pressed, in which the guiding outer cylinder 60 is also pressed, the sliding bump 72 of the rotating inner cylinder 70 is pushed downward by the positioning bump 62 of the guiding outer cylinder 60 until the sliding bump 72 crosses the second side 533. By an oblique pushing force when the upper slope 722 is slid over the lower slope 622, the positioning bumps 62 leave the sectional cutouts 530 along the pressing direction, and the sliding bumps 72 move away from the bottom ends of the positioning bumps 62 into the lodging recesses 64 of the guiding outer cylinders 60, correspondingly. At this time, the sliding bumps 72 are temporarily located under the oblique bottom sides 532 of the sectional boards 53.

When the keycap 10 is released, the rotating inner cylinder 70 and the guiding outer cylinder 60 are pushed and moved upward by the elastic force of the elastic element 80 in the rotating inner cylinder 70. During the upward restoring process, the sliding bumps 72 firstly contact the oblique bottom sides 532 of the sectional boards 53; the guiding outer cylinder 60 then moves continuously upward until the positioning bump 62 finally returns to the next sectional cutout 530. After that, the sliding bumps 72 leave the lodging recesses 64 and slide along the oblique bottom sides 532. Through the bottoms of the sectional boards 53, i.e., the oblique bottom sides 532, the sliding bumps 72 move back to the bottoms of the positioning bumps 62, as shown in FIG. 4.

Referring to FIG. 4, the guiding outer cylinder 60 of this embodiment has an extending slope 621 which is extended from the lower slope 622 to the lodging recess 64. When the keycap 10 is released, the oblique bottom side 532 of the sectional board 53, the lower slope 622 of the positioning bump 62 and the extending slope 621 of the guiding outer cylinder 60 are substantially arranged to form one slope or one cambered surface, thus allowing the sliding bumps 72 to move smoothly on the cambered surface.

Figure 6:
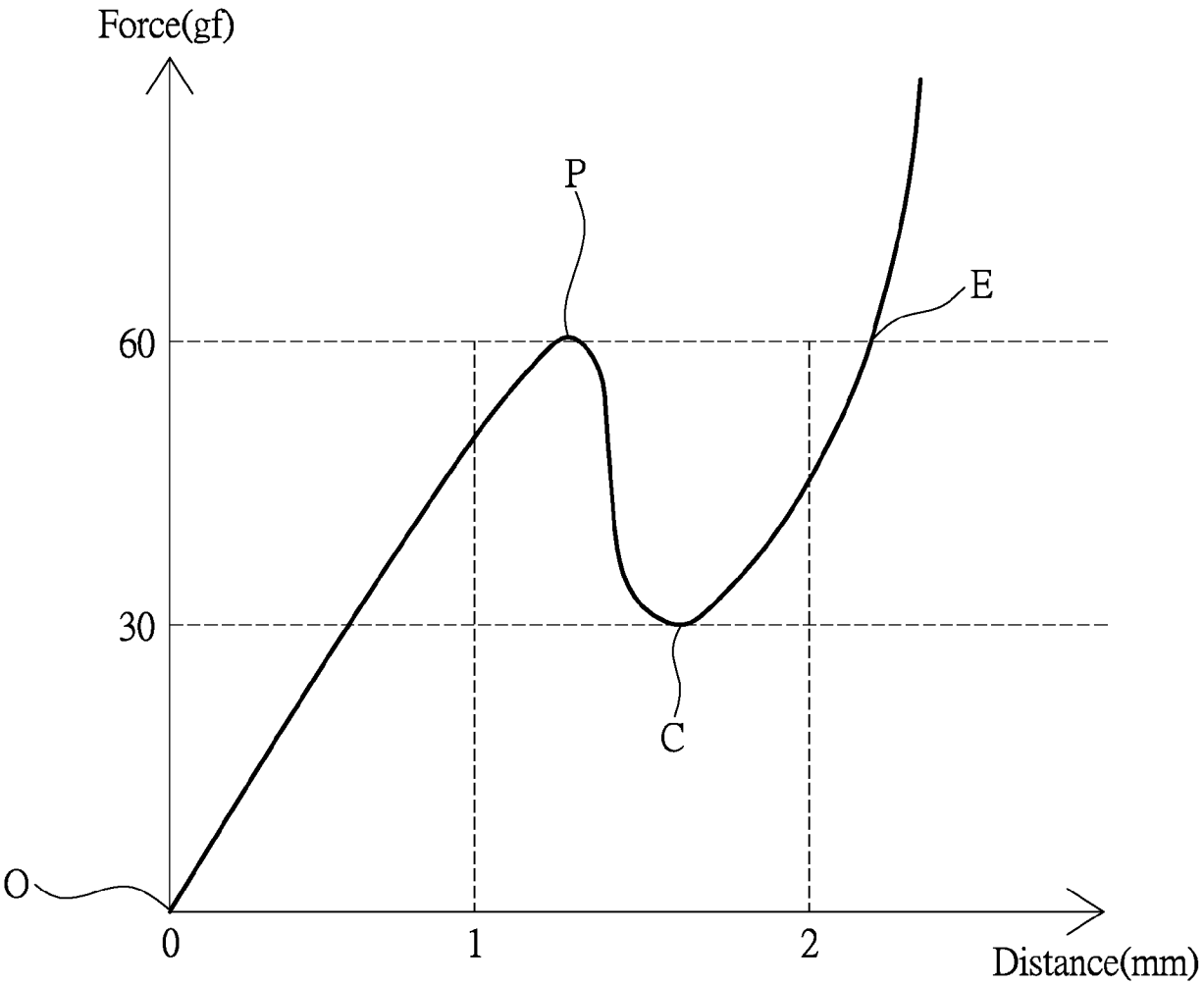
FIG. 6 is an elasticity graph showing a force curve during a pressing stroke of the key structure with mechanical switch of the present disclosure.

Referring to FIG. 6, the force-travel diagram can express a variation process of force when the keycap is pressed by the user's finger. The horizontal axis of the force-travel diagram, or the X-axis, represents a travel distance of a downward stroke action on the keycap (unit: mm). The vertical axis, or the Y-axis, represents a force applied on the keycap (unit: gram-force, i.e., gf). The point "O" represents the Original point; the point "P" represents the Peak point; the point "C" represents the Contact point; and the point "E" represents the End point. One feature of the present disclosure is that, during the pressing and releasing processes of the keycap 10, the rotating inner cylinder 70 slides along the bottom surfaces of the guiding outer cylinder 60 and the sectional board 53, so that a tactile sensation having more distinct degrees of feedback can be provided.

As shown in FIG. 6, the peak point P and the contact point C will affect the tactile feedback of the mechanical switch structure. The original point O signifies a point where the keycap 10 is not pressed yet, with a travel distance of 0 mm. The peak point P signifies a pressing stroke of the keycap 10 at a maximum force, with a travel distance of 1.3 mm, about a two-third position of the total pressing stroke distance. The elastic force curve from the original point O to the peak point P is fluctuated substantially along a linear curve, and is mainly to overcome the resistant force of the elastic element 80, much like an elasticity graph of a compressible spring.

Referring to FIG. 4, during the pressing process of the keycap 10, the guiding outer cylinder 60 is simultaneously pressed down, the travel distance thereof being equal to a downward displacement of the positioning bump 62 along the second side 533. According to the above description, if the length of the second side 533 is longer, the elastic element 80 would be more tightly compressed, so that a stronger elastic force is produced. Thus, the peak point P in this embodiment can be adjusted by changing the length of the second side 533. A force value of the peak point P of this embodiment can be adjusted by changing a coefficient of elasticity of the elastic element 80.

Referring to FIG. 6, and in accordance with this embodiment, during the pressing stroke from the peak point P to the contact point C, the user can feel an apparent lessening of the resistance force on his finger. The contact point C signifies a travel distance of about 1.6 mm. Referring to FIG. 4, when the sliding bump 72 is pushed downward by the guiding outer cylinder 60 until it crosses the second side 533 of the sectional board 53, the sliding bump 72 begins to slide along a bottom of the positioning bump 62. Firstly, the sliding bump 72 slides across a corner between the second side 533 and the oblique bottom side 532. Then, as shown in FIG. 5, the sliding bump 72 slides into the lodging recess 64 of the guiding outer cylinder 60. In the sliding process, the keycap 10 is continuously pressed downward about one-third of the total pressing stroke distance, until completing the entire pressing stroke, as shown in FIG. 5. At this time, a conductive circuit is conducted (example provided hereafter), represented by the contact point C. After a short while, the elastic element 80 is released, and a recovered length of the elastic element 80 is counterbalanced by a vertical displacement of the sliding bump 72. By virtue of the foregoing, the user would feel that an elastic force from the elastic element 80 applied on his finger has reduced evidently in a short period of time, so that a noticeable tactile feedback of a bump is provided.

According to the above description, this embodiment can adjust the curve and tactility of step difference from the peak point P to the contact point C by changing the slope and the length of the extending slope 621 of the guiding outer cylinder 60.

Referring to FIG. 6, the pressing stroke after the contact point C signifies the process of the user's finger being removed from the keycap 10. Further referring to FIG. 4, the elastic element 80 pushes the rotating inner cylinder 70, the guiding outer cylinder 60 and the keycap 10 to move upward, so that the rotating inner cylinder 70, the guiding outer cylinder 60 and the keycap 10 return to the unpressed position.

The tactile sensation is usually measured by the following pressure sections ratio, which is also called a snap ratio or a click ratio (CR %), as an objective data. The formula of the click ratio (CR %) of key pressure is listed as follows.

$$CR\ \% = (\text{Peak Force} - \text{Contact Force})/\text{Peak Force} * 100\%$$

In this embodiment, the click ratio of key pressure (CR %) is about 50%, which provides a noticeable tactile feedback of a bump. A travel-force graph of the conventional mechanical switch, which is generally equipped with a compressible spring, would show a curve from the peak point to the contact point, and a slope line which signifies a gradual increase of resistance, without an evident tactile feedback of a bump.

Second Embodiment

Figure 7:
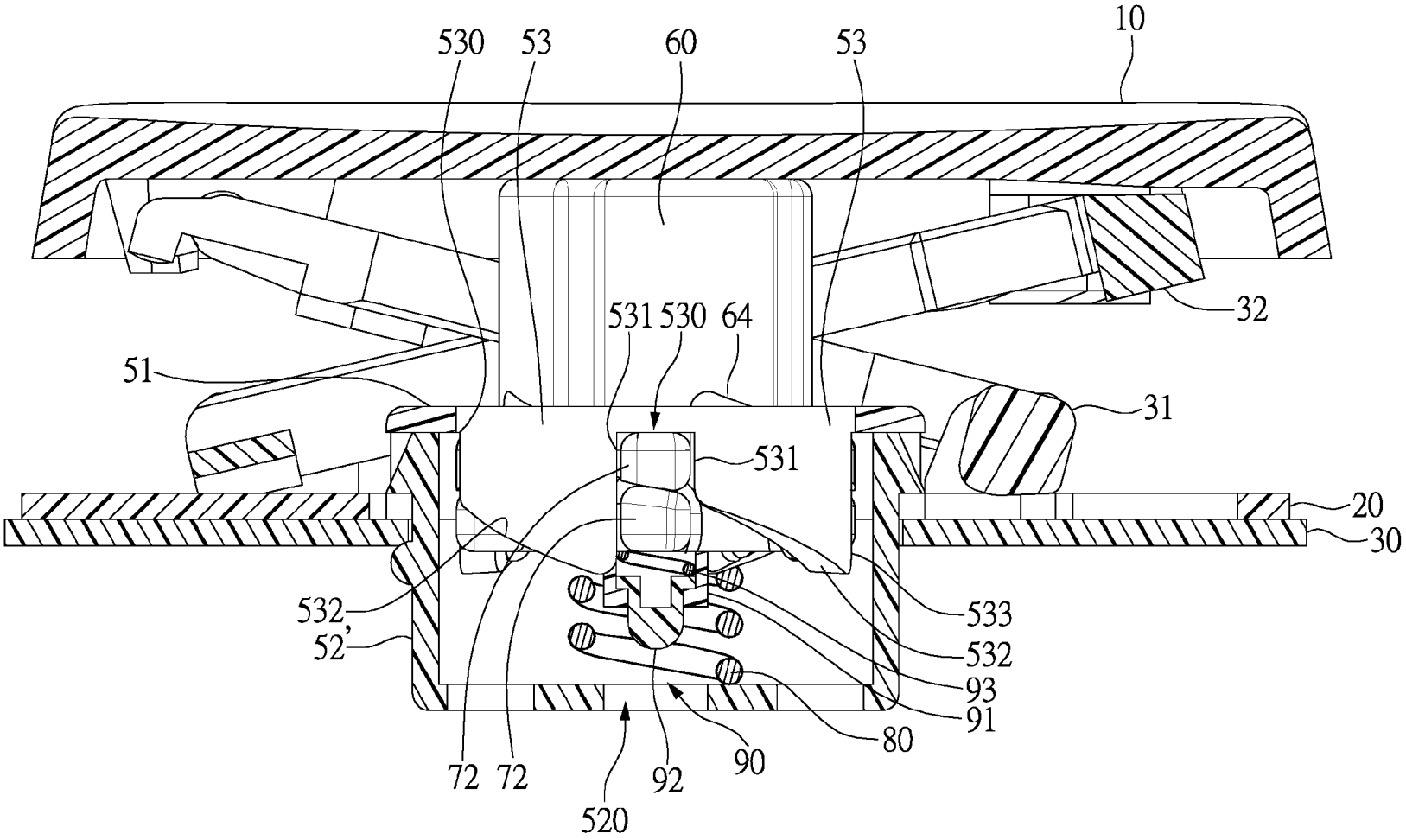
FIG. 7 is a cross-sectional view of the key structure with mechanical switch of the present disclosure in a conducted state.

Referring to FIG. 7, the difference between this embodiment and the above embodiment is that the rotating inner cylinder 70 is hollow and receives a triggering module 90 therein. A receiving housing 52' is formed with a through hole 520 on a bottom thereof. In a released state of the keycap 10, the triggering module 90 does not protrude beyond the through hole 520. In a pressed state of the keycap 10, a part of the triggering module 90 protrudes beyond the through hole 520, so as to abut against a conductive circuit membrane on a bottom of the mechanical switch to produce a conductive signal.

More specifically, the triggering module 90 includes an accommodating casing 91, a spring 93 received in the accommodating casing 91, and a triggering portion 92 that is movably received in the accommodating casing 91 and abuts against the spring 93. The triggering portion 92 has one part which partially protrudes beyond the bottom surface of the accommodating casing 91.

The present disclosure has features and functions as follows. During the pressing and releasing processes of the keycap 10, the rotating inner cylinder 70 is slid along a bottom surface of the guiding outer cylinder 60 and the sectional board 53. The sliding bump is slidably arranged on the bottom surface of the positioning bump 62 and in the sectional cutouts in turn, so that it can provide a noticeable tactile feedback of a bump. The click ratio CR % of pressure forces in this embodiment is about 50%.

In addition, the present disclosure provides a thinner key structure with mechanical switch, which has a total height of less than 7 mm.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A key structure with mechanical switch, comprising:

a keycap;

a support plate, disposed under the keycap, the support plate having an opening;

a scissor unit, disposed between the keycap and the support plate, to guide the keycap to move up or down along a pressing direction;

a receiving housing, disposed under the support plate, the receiving housing having a plurality of sectional boards arranged in an annular manner and a plurality of sectional cutouts formed among the sectional boards at intervals;

a guiding outer cylinder, received in the receiving housing and movably arranged in the pressing direction, the guiding outer cylinder protruding beyond the opening and abutting against a bottom surface of the keycap; wherein the guiding outer cylinder has a main cylinder part, a plurality of positioning bumps protruding outward from a bottom of the main cylinder part, and a plurality of lodging recesses arranged among the positioning bumps at intervals; the guiding outer cylinder having a downward hollow receiving space;

a rotating inner cylinder, received in the hollow receiving space of the guiding outer cylinder, the rotating inner cylinder having an inner cylinder part, and a plurality of sliding bumps protruding outward from a bottom of the inner cylinder part;

an elastic element, disposed underneath the rotating inner cylinder, so as to provide the rotating inner cylinder with an elastic force toward the keycap;

wherein the keycap is not pressed, the sliding bumps are respectively arranged on the bottom ends of the positioning bumps, and in the sectional cutouts;

wherein the keycap is pressed, the positioning bumps move away from the sectional cutouts in the pressing direction, and the sliding bumps are respectively slid on bottom ends of the positioning bumps into the lodging recesses;

wherein the keycap is released, and the sliding bumps are slid on bottom surfaces of the sectional boards to bottom ends of the positioning bumps.

2. The key structure with mechanical switch as claimed in claim 1, wherein the receiving housing has an upper housing and a lower housing, the upper housing having an outer edge portion engaged with the lower housing, the sectional boards being parallel to and being arranged in the outer edge portion.

3. The key structure with mechanical switch as claimed in claim 2, wherein the outer edge portion is formed with a plurality of wedding holes, an outer surface of the lower housing is formed with a plurality of hooking bumps, and the hooking bumps are correspondingly wedged into the wedding holes.

4. The key structure with mechanical switch as claimed in claim 2, wherein the lower housing is formed with a plurality of yielding holes, the positions of the yielding holes corresponding to the positioning bumps of the guiding outer cylinder respectively.

5. The key structure with mechanical switch as claimed in claim 2, wherein each of the sectional boards is formed with a guiding rib parallel to the pressing direction on an inner surface thereof, and the guiding outer cylinder is formed with a plurality of guiding slots on an outer surface thereof for receiving the guiding ribs correspondingly.

6. The key structure with mechanical switch as claimed in claim 1, wherein the positioning bump of the guiding outer cylinder has a lower slope formed on a bottom end thereof, and the lower slope is oblique relative to the pressing direction; wherein the sliding bump of the rotating inner cylinder has an upper slope formed on a top end thereof, and the upper slope is oblique relative to the pressing direction, the upper slope being abutted against the lower slope.

7. The key structure with mechanical switch as claimed in claim 6, wherein the guiding outer cylinder has an extending slope, and the extending slope is extended from the lower slope to the lodging recess.

8. The key structure with mechanical switch as claimed in claim 7, wherein each of the sectional boards has a first side, a second side and an oblique bottom side connected between the first side and the second side, and wherein the first side is shorter than the second side.

9. The key structure with mechanical switch as claimed in claim 8, wherein when the keycap is released, the oblique bottom side of the sectional board, the lower slope of the positioning bump, and the extending slope of the guiding outer cylinder are substantially arranged on one cambered surface.

10. The key structure with mechanical switch as claimed in claim 1, wherein the rotating inner cylinder is hollow and receives a triggering module therein, and the receiving housing formed with a through hole on a bottom thereof; wherein in a released state of the keycap, the triggering module does not protrude beyond the through hole, and in a pressed state of the keycap, a part of the triggering module protrudes beyond the through hole.

11. The key structure with mechanical switch as claimed in claim 10, wherein the triggering module has an accommodating casing, a spring received in the accommodating casing, and a triggering portion movably received in the accommodating casing and abutted against the spring, a part of the triggering portion protruding beyond the bottom surface of the accommodating casing.

12. A mechanical switch, comprising:

a receiving housing, having a plurality of sectional boards arranged in an annular manner and a plurality of sectional cutouts formed among the sectional boards at intervals;

a guiding outer cylinder, received in the receiving housing and movably arranged in a pressing direction; wherein the guiding outer cylinder has a main cylinder part, a plurality of positioning bumps protruding outward from a bottom of the main cylinder part, and a plurality of lodging recesses arranged among the positioning bumps at intervals, the guiding outer cylinder having a downward hollow receiving space;

a rotating inner cylinder, received in the hollow receiving space of the guiding outer cylinder, the rotating inner cylinder having an inner cylinder part, and a plurality of sliding bumps protruding outward from a bottom of the inner cylinder part;

an elastic element, disposed underneath the rotating inner cylinder, so as to provide the rotating inner cylinder with an elastic force toward the guiding outer cylinder;

wherein the guiding outer cylinder is not pressed, the sliding bumps are respectively arranged on the bottom ends of the positioning bumps, and in the sectional cutouts;

wherein the guiding outer cylinder is pressed, the positioning bumps move away from the sectional cutouts in the pressing direction, and the sliding bumps are respectively slid on bottom ends of the positioning bumps into the lodging recesses;

wherein when the guiding outer cylinder is released, the sliding bumps are slid on bottom surfaces of the sectional boards to bottom ends of the positioning bumps.

13. The mechanical switch as claimed in claim 12, wherein the receiving housing has an upper housing and a lower housing, the upper housing having an outer edge portion engaged with the lower housing, and the sectional boards are parallel to and arranged in the outer edge portion.

14. The mechanical switch as claimed in claim 13, wherein the outer edge portion is formed with a plurality of wedding holes, an outer surface of the lower housing is formed with a plurality of hooking bumps, the hooking bumps being correspondingly wedged into the wedding holes.

15. The mechanical switch as claimed in claim 13, wherein the lower housing is formed with a plurality of yielding holes, the positions of the yielding holes corresponding to the positioning bumps of the guiding outer cylinder respectively.

16. The mechanical switch as claimed in claim 13, wherein each of the sectional boards is formed with a guiding rib parallel the pressing direction on an inner surface thereof, and the guiding outer cylinder is formed with a plurality of guiding slots on an outer surface thereof for receiving the guiding ribs correspondingly.

17. The mechanical switch as claimed in claim 12, wherein the positioning bump of the guiding outer cylinder has a lower slope formed on a bottom end thereof, and the lower slope is oblique relative to the pressing direction; wherein the sliding bump of the rotating inner cylinder has an upper slope formed on a top end thereof, and the upper slope is oblique relative to the pressing direction, the upper slope being abutted against the lower slope.

18. The mechanical switch as claimed in claim 17, wherein the guiding outer cylinder has an extending slope, and the extending slope is extended from the lower slope to the lodging recess.

19. The mechanical switch as claimed in claim 18, wherein each of the sectional boards has a first side, a second side and an oblique bottom side connected between the first side and the second side, and wherein the first side is shorter than the second side.

20. The mechanical switch as claimed in claim 19, wherein when the guiding outer cylinder is released, the oblique bottom side of the sectional board, the lower slope of the positioning bump, and the extending slope of the guiding outer cylinder are substantially arranged on one cambered surface.

21. The mechanical switch as claimed in claim 12, wherein the rotating inner cylinder is hollow and receives a triggering module therein, and the receiving housing is formed with a through hole on a bottom thereof; wherein in a released state of the guiding outer cylinder, the triggering module is not protruded beyond the through hole, and in a pressed state of the guiding outer cylinder, a part of the triggering module is protruded beyond the through hole.

22. The mechanical switch as claimed in claim 21, wherein the triggering module has an accommodating casing, a spring received in the accommodating casing, and a triggering portion movably received in the accommodating casing and abutted against the spring, a part of the triggering portion protruding beyond the bottom surface of the accommodating casing.

* * * * *